United States Patent [19]

Varga-Papp

[11] Patent Number: 4,599,853

[45] Date of Patent: Jul. 15, 1986

[54] METHOD AND APPARATUS FOR MANUFACTURING COMPACT CONDUCTORS WITH BUNCHERS

[75] Inventor: Andre Varga-Papp, Ontario, Canada

[73] Assignee: Ceeco Machinery Manufacturing Limited, Concord, Canada

[21] Appl. No.: 741,452

[22] Filed: Jun. 7, 1985

Related U.S. Application Data

[63] Continuation-in-part of Ser. No. 621,485, Jun. 18, 1984, abandoned.

[51] Int. Cl.[4] ..... H01B 13/02; H01B 13/26; D07B 3/10

[52] U.S. Cl. ..... 57/9; 57/13; 57/58.52; 57/58.65; 57/59; 57/66; 57/138; 57/311; 57/314

[58] Field of Search ..... 57/9, 311, 314, 58.49, 57/58.52–58.57, 58.65–58.68, 59, 60, 62, 66–71, 138, 13–15; 140/113, 115, 149

[56] References Cited

U.S. PATENT DOCUMENTS

| | | | |
|---|---|---|---|
| 400,285 | 3/1889 | Barraclouch et al. | 57/138 |
| 1,808,444 | 6/1931 | Zapf | 57/9 |
| 2,122,911 | 7/1938 | Hunter et al. | 57/9 |
| 2,136,388 | 11/1938 | Lowe | 57/311 X |
| 2,476,180 | 7/1949 | Charles | 57/9 |
| 3,388,541 | 6/1968 | Biagini | 57/311 X |
| 3,396,522 | 8/1968 | Biagini | 57/311 X |
| 3,446,000 | 5/1969 | Smollinger et al. | 57/311 X |
| 3,811,257 | 5/1974 | Burr | 57/311 X |
| 4,098,063 | 7/1978 | Varga | 57/13 |
| 4,212,151 | 7/1980 | Schauffelle et al. | 57/138 X |

*Primary Examiner*—John Petrakes
*Attorney, Agent, or Firm*—Lilling & Greenspan

[57] ABSTRACT

An apparatus and method are described for producing compact stranded conductors on single and double twist machines. This is achieved by preshaping and metering the preshaped wires to have generally sectored cross-sectional profiled complementary configurations and positioning and orienting the preshaped wires to substantially correspond to their positions and orientations in relation to the core wire in the final compact twisted conductor. The wires are metered to a double twist strander which is used to initially twist the preshaped wires about the core wire in a generally loose construction, and these wires are subsequently locked into abutment against each other when imparted a second twist to form the compact composite conductor.

23 Claims, 5 Drawing Figures

METHOD AND APPARATUS FOR MANUFACTURING COMPACT CONDUCTORS WITH BUNCHERS

CROSS-REFERENCE TO RELATED APPLICATIONS

This application is a continuation-in-part application of U.S. patent application Ser. No. 621,485, filed on June 18, 1984 and now abandoned.

BACKGROUND OF THE INVENTION

1. Field of the Invention The invention relates to wire machinery and more specifically, to an apparatus for manufacturing compact conductors on single or double twist bunchers, twisters or stranders.

2. Description of the Prior Art

Machines sometimes denominated as stranders, twisters, single and double twist twisters, single and double twist stranders, cablers and bunchers have been in existence for many years. These machines are used to combine a plurality of individual wires and bunch or strand them together by imparting a single or double twist to them.

In the case of tubular or rigid stranders, the supply bobbins are mounted inside the rotating section or sections of the machine and the strand is pulled by an outside capstan and wound on a stationary stand. Machines of this nature are shown, for example, in U.S. Pat. No. 4,253,298. These machines have been used to make compact conductors by different methods. One such machine is described in U.S. Pat. No. 4,212,151.

In the case of the other machines mentioned above, which will be referred to as "bunchers", individual strands or wires are typically payed off from a plurality of bobbins and directed at one input end of the buncher, or at both ends of the machine in the case of the buncher described in U.S. patent application No. 602,667, filed 4/23/84 the assignee of the subject application.

The wires are grouped or bunched together at a closing point prior to entry into the machine. The closing point is fixed relative to the main part of the machine.

The bunched wires or strands are then introduced into one end of a bow which rotates about the longitudinal axis of the machine.

In the case of double twist bunchers, it is this rotation of the bow that imparts a first twist to the wires. Leaving the bow at the other end, the bunched and now twisted wires pass over a second exit pulley or sheave which rotates with the bow. From this rotating sheave the bunched or stranded cable is directed over a sheave that is mounted on a cradle that is stationary in relation to the frame of the machine. A second twist is imparted to the wire between the last sheave mounted on the bow and the first sheave attached to the cradle.

Additional pulleys disposed within the space defined by the rotating bow, guide the now double twisted cabled wires to the bobbin supported within the stationary cradle and are wound on the bobbin itself while being evenly distributed thereon. Depending on the machine, slightly different wire guide arrangements have been used.

Double twist bunchers and closers have been extensively used in the electrical wire and cable, steel tire cord and steel rope industries for many years.

Typical machines are illustrated in the "Electrical Wire & Cable Machinery" catalog published by Ceeco Machinery Manufacturing Limited, the assignee of the subject application. Other exemplary structures of existing machines are disclosed in U.S. Pat. Nos. 3,570,234 and 3,732,682.

Machines for twisting a plurality of wires with the single twist system comprise a rotatable flyer and a reciprocally traversing reel rotatably supported within the flyer. A speed differential exists between the rotation of the flyer and the reel.

In order to keep a constant lay, the rotation of the flyer and of the bobbin are controlled in such a way that a constant lay is maintained and a single twist is imparted to the individual wires fed through the flyer and onto the reel. Machines of this kind are described, for example, in U.S. Pat. Nos. 2,817,948 and 4,235,070.

The above machines are normally used to manufacture uncompacted stranded or bunched conductors where the round cross-section of each individual wire is maintained in the final stranded or bunched conductor thereby introducing spaces or interstices between adjacent strands.

In order to maximize the current carrying capacity of conductors with a specified cross-section of the final or stranded cable, or to reduce that cross-section for a specified current carrying capacity, techniques have been developed to reduce the empty spaces in a stranded conductor by pulling a conventionally stranded cable through compacting dies or roller dies. By doing this, each round wire is randomly deformed and compressed against the others resulting in a smaller overall cross-section with the same ampacity rating as the larger non-compacted conductor. This is important, especially when such a stranded cable is subsequently insulated since the amount of insulating material necessary can be substantially reduced and therefore the cost of the overall finished cable is lowered.

Since a large amount of energy is required to force and pull a stranded conductor through a die in order to compact it, this process is usually carried out with tubular or rigid stranders such as those described in the Ceeco Machinery Manufacturing Limited "Electrical Wire & Cable Machinery" catalog, or, for example, in U.S. Pat. No. 4,098,063.

Tubular stranders and rigid stranders are expensive machines and attempts have been made to manufacture compact conductors with single twist and double twist equipment or bunchers. These latter machines are most productive since for similar products they can impart a higher number of twists per minute. However, there are many difficulties in achieving acceptable compact conductor quality and in providing the required pulling forces within the small confines or limited space within the cradle of the machines. In the state-of-the-art double twist machines, all the compacting must take place in the cradle just before the takeup reel. Therefore, prior art double twist machines have to be run at reduced speeds when producing compact conductors' of acceptable quality.

In double twist machines there is a further complication due to the fact that the two twists take place, one at the entry pulley of the bow and the second one at the exit pulley as previously mentioned.

As a consequence of the second twist there is a tendency to shorten the effective length of the other wires relative to the center wire. The result of this action is to distort the wires prior to the compacting device. The state-of-the-art compacting devices overcome this distortion by stretching all the wires in order to produce an acceptable compact conductor. The force exerted on the wires necessary to achieve this objective is considerable, resulting in (a) inefficient use of energy, (b) reduced speed capability, (c) poor product quality, and (d) lower degree of compactness.

Therefore, the state-of-the-art equipment does not produce a compact conductor comparable with those that can be manufactured with more expensive and slower machines such as tubular and rigid stranders where the compaction process can take place outside of the rotating body of the machine and therefore power and/or space factors are of little or no importance.

SUMMARY OF THE INVENTION

In view of the aforementioned disadvantages inherent in the process of manufacturing compact stranded conductors with double or single twist machines, it is an object of the present invention to provide a method and apparatus and apparatus for manufacturing conductors with a high degree of compactness.

It is another object of the present invention to provide an improved method and apparatus to produce high quality compact conductors with improved diameter uniformity and dimensional integrity utilizing single and double twist machines.

It is still another object of the present invention to provide a method and apparatus to produce a compact conductor on a single or double twist buncher at substantially higher speeds without significantly increasing the cost of the equipment.

It is a further object of the invention to provide a method and apparatus to produce compact stranded conductors with a single or double twist buncher with substantially better surface quality and dimensional integrity than previously achieved with such equipment.

It is still another object of the present invention to provide a method and appartus to produce a compact conductor on a single or double twist buncher with superior conductivity due to the reduced amount of metal working imparted to the wires during the process.

Another object of the present invention is to facilitate the production of compact conductors using less energy than needed by prior art methods and apparatus.

A further object of the present invention is to provide a method and apparatus to produce compact conductors which will significantly reduce the amount of waste or scrap.

Another important object of this invention is to facilitate the manufacture of compact conductors made of soft metals and alloys having low tensile strength the surface of which is readily damaged. Although conductors of very soft aluminum alloys may become in high demand because of their greater flexibility and malleability, such conductors cannot be effectively produced with the required precision and by prior art quality methods or apparatus.

It is yet another object of the present invention to allow production of compact stranded cables made of different metals, such as cables having steel cores or center wires and an overlay of aluminum wires or strands.

In order to achieve the above objectives, as well as others which will become apparent hereafter, apparatus for making twisted compact conductors in accordance with the invention comprises means for providing a plurality of complementary preshaped wires each having the desired cross-sectional profiled configuration in the final compact conductor and each defining lateral surfaces. Means is provided for metering the preshaped wires, and means is provided for positioning and orienting the preshaped wires with relation to each other to substantially correspond to the positions and orientations therebetween in the final twisted compact conductor. Means is provided for imparting at least one twist to the wires to cause, the lateral surfaces of adjacent preshaped wires to substantially abut against each other, whereby interstices between the wires forming the twisted conductor are substantially eliminated to form a compact twisted conductor. A core wire strand or assembly may be introduced prior to the twisting or compaction step, in which case the preshaped wires are advantageously provided with an inner surface which corresponds to the shape of the core wire, whereby twisting of the wires also causes the inner curved surfaces to mate with and abut against the core wire.

A method is also described for making twisted compact conductors by using, for example, the above apparatus in accordance with the invention.

In accordance with a presently preferred embodiment, the wires forming the conductors to be utilized, excluding the center wire, are guided through shaping rolls which impart to each wire substantially the same shape and cross-section that each wire will have after the complete twisting process has been completed. The wires are then fed through a lay plate or an arrangement of lay plates which directs and orients all the wires to the approximate positions of the wires in the final conductor.

In view of the fact that almost the totality of the energy required to shape the conductor takes place outside of the machine at the shaping station, the power and pulling force required in the cradle is negligible as compared to the force necessary to manufacture standard, uncompacted stranded conductors. This allows the manufacture of high quality compacted conductors on double twist machines at substantially higher speeds with better surface properties than was previously possible.

BRIEF SUMMARY OF THE DRAWINGS

Other objects, features and advantages of the present invention will become more apparent from a reading of the following specification, when taken in conjunction with the accompanying drawings, in which.

DESCRIPTION OF THE PREFERRED EMBODIMENTS

Figure 1:
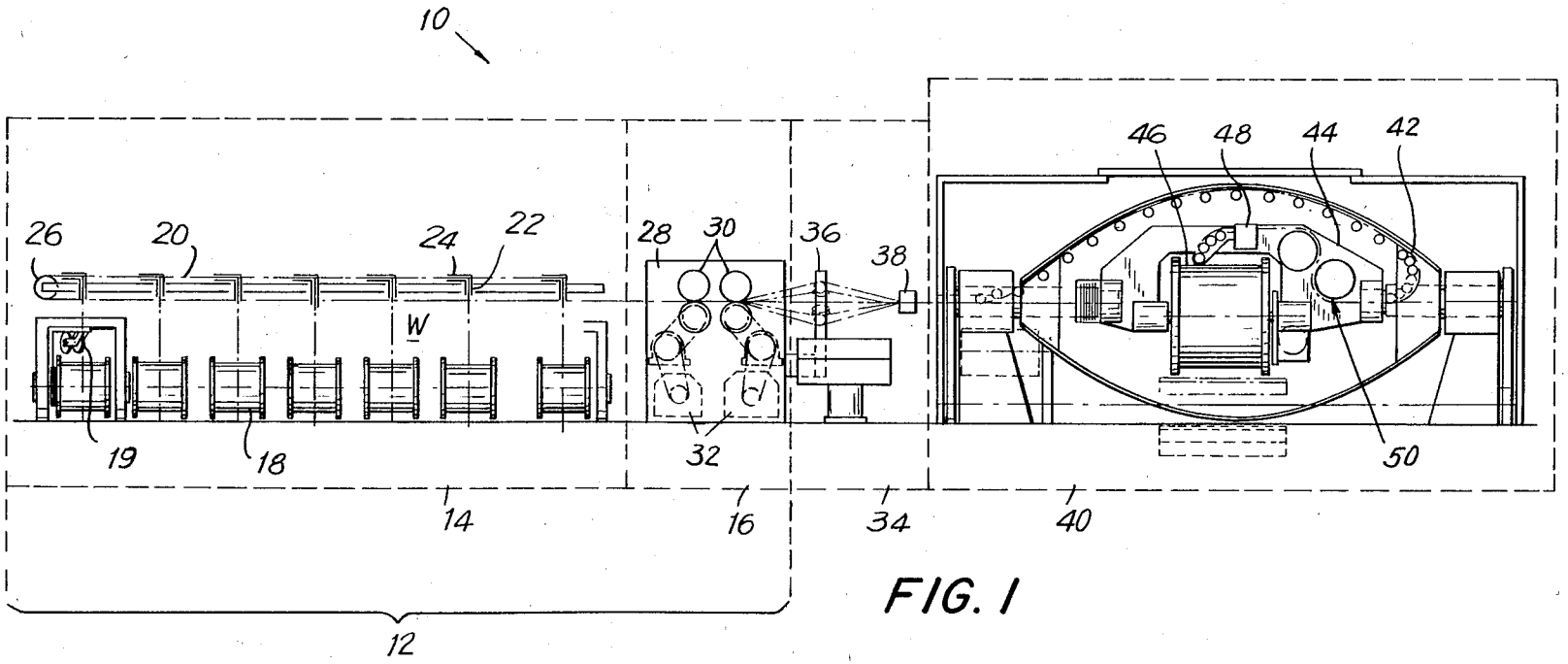
FIG. 1 is a schematic representation, in side elevation, of an apparatus for making compact conductors in accordance with the present invention.

Referring now specifically to the drawings in which the identical or similar parts are designated by the same reference numerals throughout, and first referring to FIG. 1, an apparatus for making twisted compact conductors is generally designated by the reference numeral 10.

The apparatus 10 includes a source 12 of core and preshaped wires C and W, respectively. The preshaped wires W are, in the presently preferred embodiment, formed during and as part of the manufacture of the compact conductors, to be further described below. The source 12 of the wires in FIG. 1 includes a payoff section 14 and a wire shaper 16. The payoff section 14 includes a number of bobbins 18 which are initially filled with wire W. Normally, the wire W would have a circular cross-section. However, this is not a critical feature of the invention and any appropriate wire cross-section can be used, with different degrees of advantage. Also, while a core wire C is shown, it will be clear to those skilled in the art that a core wire is not essential and the apparatus and method of the invention can be practiced without a single or multi-strand core wire.

The payoff section 14 in FIG. 1 has seven bobbins 18, the number that will be used in making a conventional stranded cable having a core and six outside wires stranded about the core wire. Advantageously, each bobbin 18 cooperates with a tensioning device 19 which adjusts the tension of the wires W during the stranding process. The type of tensioning device is not critical and may be of the type described in U.S. Pat. No. 4,423,588 assigned to the assignee of the present application.

The payoff section includes a pulley rack 20 carrying pulleys 22, 24 associated with each of the bobbins 18 to allow the direction of the wires W to be modified and directed toward a roller 26 which, in turn, redirects all wires W towards the stranding machines as to be described.

Figure 2:
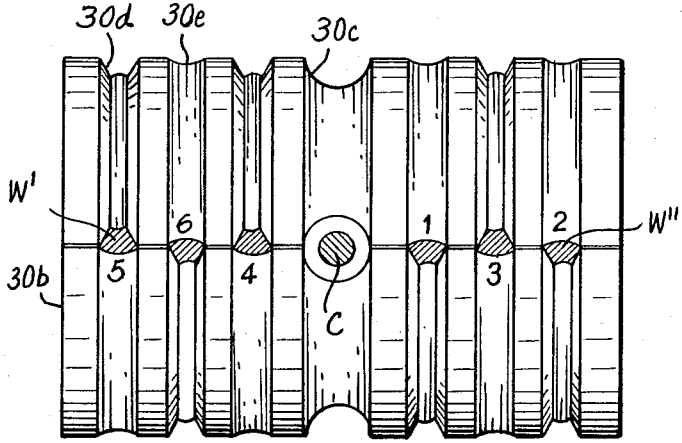
FIG. 2 is an enlarged view of the shaping rollers used in the embodiment shown in FIG. 1.

The wire shaper 16 includes at least one pair of forming rollers 30. Referring to FIG. 2, the rollers are shown to include an upper and lower rollers 30*a* and 30*b*. Each of the rollers 30*a* and 30*b* are provided with a generally semi-circular groove 30*c* which, when the rollers are arranged as shown, provide a generally circular opening through which the center or core wire C can pass without modification. Each of the rollers is also provided with a series of grooves spaced from each other about the respective axes of rotation. In the rollers shown in FIG. 2, each roller 30*a*, 30*b* is provided with 3 grooves having generally 'V' shaped profiles 30*d* and generally shallow arculate profiles 30*e*. Each shallow groove 30*e* on one of the rollers is arranged in the same plane with a 'V' shaped groove 30*d* in the other of the rollers to define forming areas generally having the shape of the arcuate sectors. It will also be noted that the cooperating 'V' shaped grooves 30*d* in roller 30*a* with the shallow grooves 30*e* in roller 30*b* form upwardly oriented sector areas as viewed in FIG. 2. Downwardly sectored areas are defined by the cooperating shallow grooves 30*e* in the roller 30*a* with the 'V' shaped grooves 30*d* in roller 30*b*. The sectored areas defined by the cooperating grooves, as described, compress and shape the wires passing between the rollers and assume shaped W', in the upwardly facing sectored areas, and W" in the downwardly facing sectored areas. The shapes of the sectored areas defined by the associated grooves on each of the rollers 30*a*, 30*b* is selected to correspond to the desired cross-sectional profiled complementary configurations of the outside wires in the final compacted product. To change the profiles for any desired compacted product it is only necessary to change the rollers and provide the appropriate grooves as will be readily evident to those skilled in the art.

A feature of the present invention is a provision of means for positioning and orienting the preshaped wires W' and W" with relation to each other and/or to the core wire C to substantially correspond to the positions and orientations that these wires assume in the final twisted compact conductor.

Figure 3:
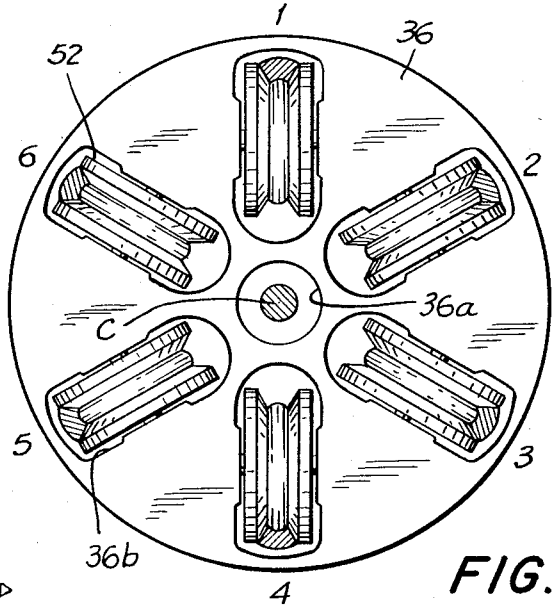
FIG. 3 is an enlarged view of the lay plate used in the embodiment of FIG. 1.

In the presently preferred embodiment, the device for positioning and orienting the wires is designated by the reference 34 and includes a lay plate 36 and a closing die 38. One embodiment of a lay plate that can be used is shown in FIG. 3 and includes a central circular opening 36*a* and a series of 6 generally radially directed openings 36*b* each designed and configurated to accommodate a pulley 52. The pulleys are mounted about their respective axes for rotation, and are provided with grooves which generally correspond to the grooves 30*d* in the forming rollers 30*a* and 30*b*.

Referring to FIGS. 2 and 3, the generally upwardly directed sectors W' are directed to the three lower pulleys 52 while the downwardly directed sectors W" are directed to the three upper pulleys 52 to avoid excessive twisting of the preshaped outer wires. Numerals 1-6 have been indicated in FIGS. 2 and 3 to designate each of the outside wires W' and W" and how they may be arranged prior to gathering in the closing die 38. However, the specific wires and the associated pulleys 52 need not be identical to the suggested arrangement shown, as long as the wires are not excessively twisted or otherwise damaged or deformed prior to passage through the lay plate 36.

Figure 4:
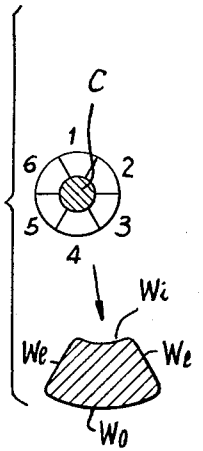
FIG. 4 is a cross-sectional view of the compact conductor made with the embodiment shown in FIG. 1, showing the manner in which the preshaped wires are arranged about the core wire, and also showing enlarged cross-section of one of the preshaped wires.

Once the wires C, W' and W" have passed through the closing die 38, they generally assume the compact arrangement as shown in FIG. 4, although there are spaces between the wires and they form a somewhat loose twisted construction.

From the closing die 38, the wires C, W' and W" are advanced into a twisting device 40. The twisting device shown is a double twist bow strander, including a bow assembly 42, a craddle 44, a reel 46 mounted in the cradle and a traverse mechanism 48. An inside or pulling capstan is advantageously and commonly provided within such machines for drawing the wires thereinto. Between the last stationary point and the input sheave of the bow assembly 42, the wires are imparted a first twist. At the output end of the bow assembly 42, the wires are imparted a second twist and this is sufficient to draw the wire C, W' and W" into abutment against each other to assume the fully closed and compact construction shown in FIG. 4, wherein the lateral surfaces $W_1$ of adjacent wires substantially abut against the core wire C. In FIG. 4, the composite wire shows no interstices between the individual wires or strands and forms a compact twisted conductor.

The contours of the outer surfaces $W_o$, formed by the shallow grooves 30*e*, are selected to define a generally circular outer surface of the composite conductor when the final product is wound about the reel 46.

One aspect of the invention is that the strands or wires are closed by twisting the same at the stationary closing die. The shaping rollers 30 and the lay plate 36 can be stationary relative to the frame of the machine 40. This simplifies the construction of the drives required for the metering of the wires to be stranded and compacted for a higher quality, more uniform product.

Additionally, in order to avoid "loose" stranded wires and to avoid excessive compaction, it is important to advance the core and wires C, W' and W'' in a metered fashion. This insures that the wires will initially exhibit a desired loose construction after the first twist, although all the wires will generally be positioned and oriented in the positions shown in FIG. 4. With the proper degree of looseness after the first twist, the second twist will pull the preshaped strands or wires and the core wire C (if a core wire is used) together into abutment against each other as shown in FIG. 4. With a given speed of rotation of the machine 40, the wires C, W' and W'' can be configured in the desired compacted form by controlling the metering rate of the individual wires or strands. This is not possible, practical or economically viable where the finished stranded wire is pulled by a capstan on the outlet side of the closing die.

Figure 5:
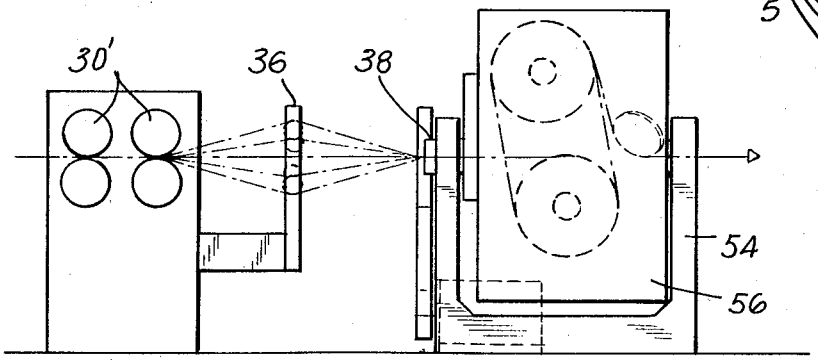
FIG. 5 is a side elevational view, in schematic, of an alternate embodiment for the wire shaper shown in FIG. 1.

The description herein has been of a preferred but representative, embodiment. Variations and modifications thereof may be possible without departing from the spirit of the invention. For example, instead of using powered forming rollers 3–0 as shown in FIG. 1, it is possible to use non-powered forming rollers 30'. In the latter case, there may be used a frame 54 on which there is mounted a powered rotating capstan 56. In the arrangement of FIG. 1, the drives 32 provide the energy for the forming of the outside wires W and W''. In the arrangement of FIG. 5, such energy is derived from the powered rotating capstan 56. Of importance in both approaches is that the wires are shaped and metered outside and prior to entering the twisting device 40 where space for pulling devices is limited.

The powered rotating capstan 56, when used, is of a conventional construction and is made to rotate at a speed relative to the rotation of the twisted device 40 to impart the number of twists required by the final product lay.

Another modification that may be made to describe the embodiment is the use of a plurality of dies each having openings generally corresponding to the areas formed by the associated grooves **30*d* and 30*e* in FIG. 2, which dies may be used for pre-shaping the outside wires. With such an arrangement, the dies would replace the wire shaper 16. The lay plate 36 would still advantageously be used between the dies and the twisting device 40**.

Also, while a double twist bow strander has been shown and described to impart the twisting, it will also be apparent that other twisting devices can be used, including single and double twisters and rotary takeup devices such as telephone stranders.

The invention also involves a method of making compact conductors which includes the steps of pre-shaping and metering a plurality of wires in order to impart thereto desired cross-sectional profiled complementary configurations and advancing the preshaped wires together with a core wire (optional) through a twisting device and imparting at least one twist to the individual wires or strands to draw these together to compact composite twisted conductor which exhibits very little if any interstices or spaces between the strands. The core wire may also be metered, although this is optional.

While it is preferable to simultaneously pre-shape the outer conductors during the wire twisting or stranding operation, as described, the same product can be manufactured by using bobbins 18 already provided with preshaped wires having cross-sectional configurations as shown in FIG. 4. In that case, of course, the wire shaper 16 in FIG. 1 can be eliminated. Including a wire shaper 16, however, is preferred since any conventional wires W can be used and different sizes and configurations of the outside stranded wires can be easily achieved by simply changing the shaping rollers 30 or the dies, if these are used instead.

The present invention permits the manufacture of compact stranded cables made of different metals. It has been virtually impossible, particularly on double twisters, to produce compact cables having steel center cores and aluminum peripheral conductors because steel is much harder and less ductile than aluminum. Since it is not possible to deform the center steel wire when the aluminum wires are twisted and stretched, imparting two twists to the aluminum wires would normally result in breakage of the aluminum wires due to excessive stretching during the stranding operation. With the present approach, the steel core wire is pulled through the machinery without deformation. The preshaped wires made, for example, from aluminum, are preshaped and metered in a quantity to assure some looseness of construction after the first twist. At the time of the second twist, the outside conductors can be drawn into abutment against each other, as described, without deformation of the center wire or excessive stretching of the preshaped wires. For this reason, for the first time, production of high quality compact stranded conductors with steel cores and softer metal peripheral wires or strands, in an efficient manner on, for example, double twist machines.

Additionally, because the payoff bobbins 18 are stationary and outside the buncher, the ends of wires of bobbins which are near empty can be connected to the leading ends of full bobbins so that empty bobbins can be easily replaced without disruption or stoppage of the rotating machine and without the incurrence of waste or scrap as is the case with tubular or rigid stranders.

What is claimed is:

1. Apparatus for making twisted compact conductors including a plurality of wires comprising means for providing a plurality of complementary segmented preshaped wires each having a desired cross-sectional profiled configuration in the final compact conductor and each defining at least lateral surfaces; means for positioning and orienting the preshaped wires with relation to each other to substantially correspond to the positions and orientations therebetween in the final twisted compact conductor; twisting means, downstream of said means for positioning and orienting, for imparting at least one twist to the wires; means for feeding the wires to said twisting means at a rate of speed to cause the lateral surfaces of adjacent preshaped wires to substantially abut against each other and to produce the desired lay, whereby interstices between the wires forming the twisted conductor are substantially eliminated to form a compact twisted conductor.

2. Apparatus for making twisted compact conductors as defined in claim 1, wherein said means for providing the wires comprises a plurality of payoffs each issuing a wire and means for shaping each of the wires with the desired cross-sectional profiled complementary configuration.

3. Apparatus for making twisted compact conductors as defined in claim 2, wherein said means for shaping comprises a plurality of dies for shaping the wires.

4. Apparatus for making twisted compact conductors as defined in claim 2, wherein said means for shaping comprises at least one pair of shaping rollers for shaping the wires.

5. Apparatus for making twisted compact conductors as defined in claim 4, further comprising means for driving said shaping rollers, whereby shaping of the wires is achieved substantially at said shaping rollers by the action of said drive means.

6. Apparatus for making twisted compact conductors as defined in claim 1, wherein said feeding means comprises capstan means between said means for providing and said twisting means.

7. Apparatus for making twisted compact conductors as defined in claim 6, wherein said capstan means comprises a rotating capstan which twists the wires at a rotating speed relative to the rotation of said twisting means required by the final lay of the product.

8. Apparatus for making twisted compact conductors as defined in claim 1, wherein said means for positioning and orienting comprises a lay plate.

9. Apparatus for making twisted compact conductors as defined in claim 8, wherein said lay plate comprises a stationary plate having a plurality of openings therein each accommodating a pulley having a groove configured to at least partially correspond to the desired cross-sectional profiled complementary configuration of the preshaped wires, said pulleys being arranged to position and orient the preshaped wires to generally correspond to the relative positions of the preshaped wires in the assembled twisted compact conductor.

10. Apparatus for making twisted compact conductors as defined in claim 9, further comprising a closing die to gather preshaped wires into close proximity to each other following passage through said lay plate and prior to passage into twisting means.

11. Apparatus for making twisted compact conductors as defined in claim 1, wherein said twisting means comprises a twister.

12. Apparatus for making twisted compact conductors as defined in claim 11, wherein said twister comprises a double twist twister.

13. Apparatus for making twisted compact conductors as defined in claim 11, wherein said twister comprises a single twist rotary takeup device.

14. Apparatus for making twisted compact conductors as defined in claim 1, wherein the compact conductor includes a core wire, and further comprising means for providing a core wire, each of the preshaped wires being provided with an inner surface which corresponds to at least a portion of the external surface of the core wire, said means for positioning and orienting arranging said preshaped wires with relation to the core wire and to each other to substantially correspond to the positions thereof in the finished twisted compact conductor.

15. Apparatus for making twisted compact conductors as defined in claim 14, wherein said twisting and feeding means cause the lateral surfaces of adjacent preshaped wires to substantially abut against each other and to cause the inner surface of each preshaped wire to substantially abut against the core wire.

16. Aparatus for making twisted compact conductors as defined in claim 1, further comprising metering means for feeding the wires at the desired rate of speed to said twisting means.

17. A method of making compact conductors comprising the steps of providing and feeding a plurality of complementary segmented preshaped wires each having a desired cross-sectional profiled configuration in the final compact conductor and each defining at least lateral surfaces; positioning and orienting the preshaped wires with relation to each other to substantially correspond to the positions and orientations therebetween in the final twisted compact conductor; imparting at least one twist to the wires after the wires have been positioned and oriented, the feeding of the preshaped wires taking place at the rate of speed to cause the lateral surfaces of adjacent preshaped wires to substantially abut against each other and to produce the desired lay of the product, whereby interstices between the wires forming the twisted conductor are substantially eliminated to form a compact twisted conductor.

18. A method as defined in claim 17, wherein said step of providing the wires includes shaping each of the wires with the desired cross-sectional profiled complementary configuration.

19. A method as defined in claim 18, wherein the shaping step includes passing the wires between shaping rollers.

20. A method as defined in claim 18, wherein the shaping step is performed prior to the step of imparting said at least one twist to the wires.

21. A method as defined in claim 17, wherein a core wire is provided and the core wire and the preshaped wires are made from different metals.

22. A method as defined in claim 21, wherein the core wire is made of steel and the preshaped wires are made of aluminum.

23. A method as defined in claim 17, further comprising the step of feeding the preshaped wires while feeding the same.

* * * * *